US006136147A

United States Patent [19]

Edwards et al.

[11] Patent Number: 6,136,147

[45] Date of Patent: Oct. 24, 2000

[54] METHOD FOR APPLYING DEBONDING MATERIALS TO A TISSUE

[75] Inventors: Steven Lawrence Edwards, Fremont; Michael John Smith, Neenah, both of Wis.

[73] Assignee: Kimberly-Clark Worldwide, Inc., Neenah, Wis.

[21] Appl. No.: 08/283,934

[22] Filed: Aug. 1, 1994

[51] Int. Cl.[7] ..... D21H 21/22

[52] U.S. Cl. ..... 162/135; 162/112; 162/164.4; 162/184; 162/207; 427/255.6; 427/377; 427/422; 427/424

[58] Field of Search ..... 162/111, 112, 162/113, 158, 164.4, 135, 183, 184, 186, 207; 427/255.6, 255.5, 377, 422, 424

[56] References Cited

U.S. PATENT DOCUMENTS

| | | | |
|---|---|---|---|
| 3,484,275 | 12/1969 | Lewicki | 162/135 |
| 4,942,077 | 7/1990 | Wendt et al. | 428/152 |
| 4,950,545 | 8/1990 | Walter et al. | 428/446 |
| 4,994,144 | 2/1991 | Smith et al. | 162/207 |
| 5,059,282 | 10/1991 | Ampulski et al. | 162/111 |
| 5,164,046 | 11/1992 | Ampulski et al. | 162/111 |
| 5,215,626 | 6/1993 | Ampulski et al. | 162/112 |
| 5,227,242 | 7/1993 | Walter et al. | 428/446 |
| 5,246,545 | 9/1993 | Ampulski et al. | 162/112 |

FOREIGN PATENT DOCUMENTS

| | | |
|---|---|---|
| 0404189 | 12/1990 | European Pat. Off. . |
| 804198 | 11/1958 | United Kingdom . |

*Primary Examiner*—Peter Chin
*Attorney, Agent, or Firm*—Gregory E. Croft

[57] ABSTRACT

Debonders, particularly including polysiloxanes, are applied to tissue webs by atomizing the debonder and applying the debonder to the tissue with a steam jet as a debonder/steam mixture. The debonder is applied after the creping blade and prior to the reel. Other suitable debonders include quaternary ammonium surfactants.

10 Claims, 2 Drawing Sheets

METHOD FOR APPLYING DEBONDING MATERIALS TO A TISSUE

BACKGROUND OF THE INVENTION

In the manufacture of facial tissues, it is known that the addition of certain debonders, such as polysiloxanes, to the tissue can improve the feel of the tissue. Depending on the particular debonder being used, these materials can be applied to the tissue web at different points in the tissue making process ranging from the wet end to converting. In the case of polysiloxanes, spraying and printing aqueous solutions or suspensions of such materials are accepted methods of application.

SUMMARY OF THE INVENTION

It has now been discovered that debonders, such as polysiloxanes, can be advantageously applied to the tissue web after the creping blade and prior to the reel by atomizing the debonder and applying it to the tissue with a steam jet. By combining the debonder with steam, the resulting tissue can be made softer and bulkier than if either component is added alone. As used herein, the term "debonder" means a material which softens or lubricates the tissue surface.

Hence in one aspect the invention resides in a method of applying debonder to a tissue web comprising: (a) atomizing a debonder or a solution of the debonder, dispersing the atomized debonder with steam to form a debonder/steam mixture, and spraying the atomized debonder/steam mixture onto the surface of the tissue web. While the method of this invention is particularly applicable to creped webs, other tissue webs, such as uncreped throughdried webs, can also be used provided they have at least about 10 percent machine direction stretch. The presence of adequate stretch is desirable because it imparts softness to the tissue sheet and helps to minimize breaks during the converting operations.

The steam can be subcooled, saturated or superheated. The amount of steam in the debonder/steam mixture can be from about 0.1 to about 1 weight percent based on the weight of the debonder, more specifically from about 0.4 to about 0.6 weight percent.

The add-on rate of the debonder can be from about 0.1 to about 5 weight percent based on the dry weight of the tissue, more specifically from about 0.5 to about 1.5 weight percent based on the dry weight of the tissue.

Preferred debonders for purposes of this invention are polysiloxanes. Suitable polysiloxanes include any polysiloxane useful for providing a soft feel to tissues. Such polysiloxanes include those disclosed in U.S. Pat. No. 5,059,282 entitled "Soft Tissue Paper" issued to Ampulski et al. on Oct. 22, 1991 and U.S. Pat. No. 4,950,545 entitled "Multifunctional Facial Tissue" issued to Walter et al. on Aug. 21, 1990, both of which are herein incorporated by reference. Other suitable debonders include single quaternary ammonium compounds, such as dialkyldimethylammonium chloride or dihydrogenated-tallow dimethylammonium chloride, and diquaternary ammonium compounds such as cetra ammonium chloride. The debonders are preferably atomized in the form of a solution, such as an aqueous solution. Other suitable softening materials which can be carried to the tissue with steam include any nonionic or anionic surfactant that provides a debonding effect or a desired surface feel to the tissue substrate.

DETAILED DESCRIPTION OF THE DRAWING

Figure 1:
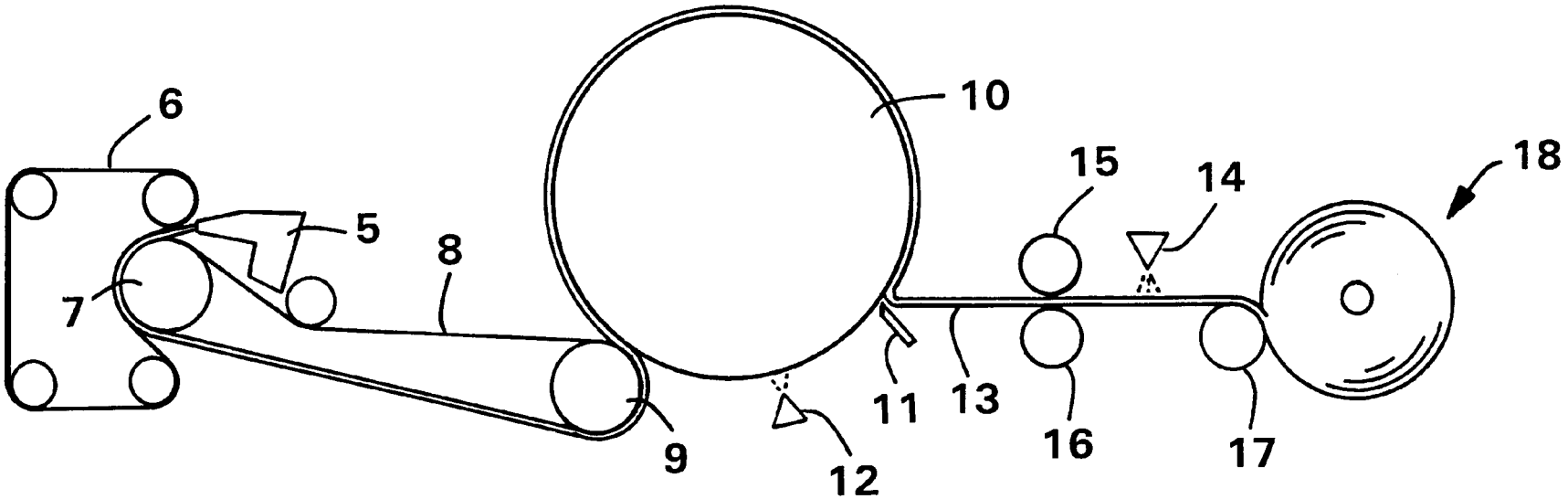
FIG. 1 is a schematic flow diagram of the tissue making process, illustrating the position of the debonder/steam jet.

Referring to FIG. 1, shown is a flow diagram of a tissue making process incorporating the use of a polysiloxane/steam jet in accordance with this invention. The specific forming configuration illustrated is commonly referred to as a crescent former, although any other forming configuration can be used. Shown is the headbox 5, the forming fabric 6, the forming roll 7, the papermaking felt 8, the pressure roll 9, the Yankee dryer 10, the creping blade 11, the creping adhesive sprayer 12, the creped web 13, the polysiloxane/steam jet 14, optional calender rolls 15 and 16, reel drum 17, and soft roll 18 wound around the reel.

In operation, the headbox continuously deposits an aqueous suspension of papermaking fibers onto the forming fabric between the forming fabric and the felt. Water is removed from the aqueous stock suspension through the forming fabric by centrifugal force as the newly-formed wet web traverses the arc of the forming roll. As the forming fabric and felt separate, the wet web stays with the felt and is carried to the Yankee dryer. The wet web is pressed against the surface of the Yankee dryer by the pressure roll, which partially dewaters the web. The pressing step, in combination with the adhesive sprayed onto the surface of the Yankee, causes the web to adhere to the surface where it is dried and creped. The creped web is calendered, sprayed with the atomized polysiloxane/steam mixture and wound into a softroll on the reel. Optionally, the creped web is sprayed with the polysiloxane/steam mixture after the creping blade in the absence of calendering.

Figure 2:
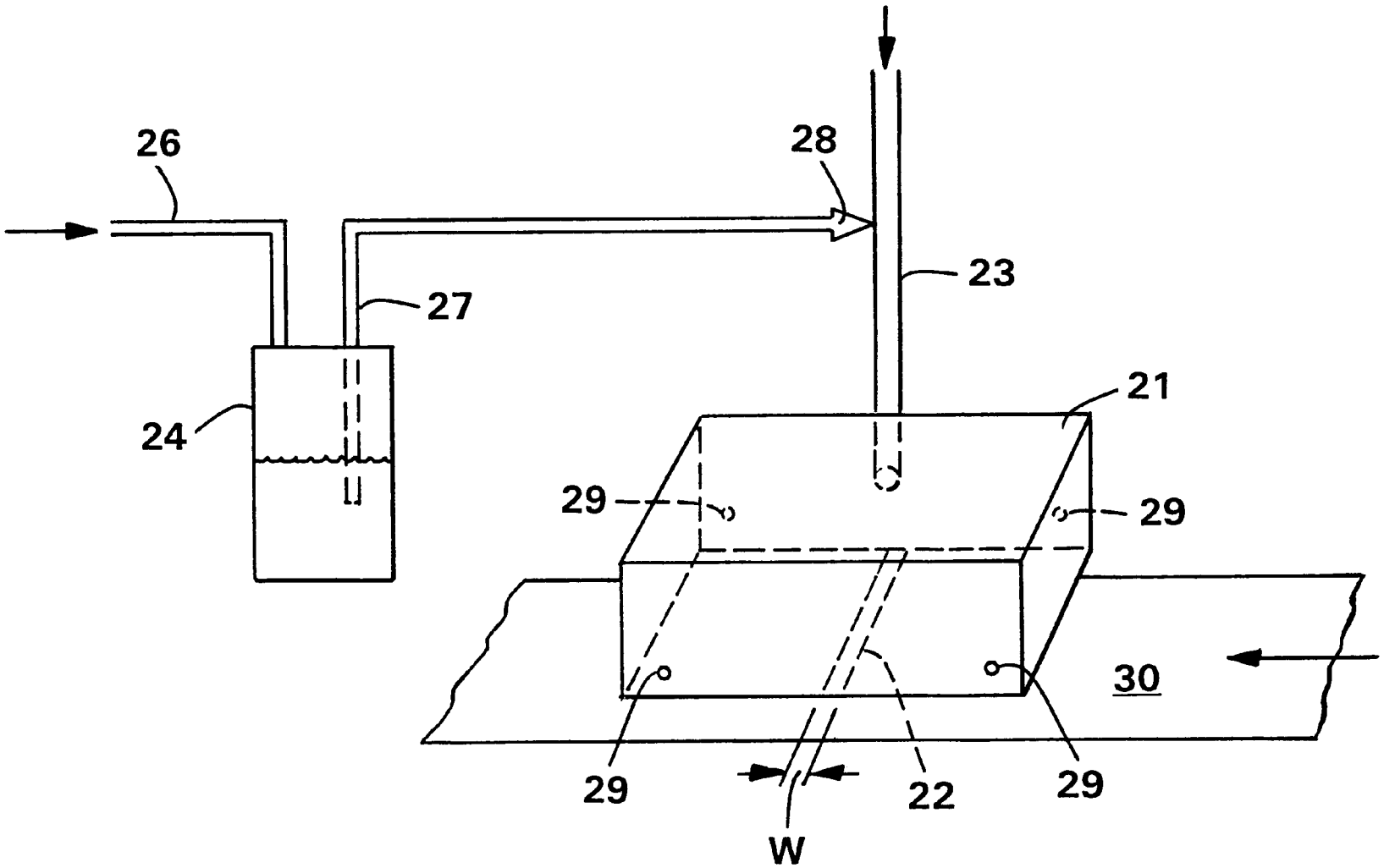
FIG. 2 is a schematic view of the debonder/steam jet, illustrating the feeding and mixing of the debonder with the steam.

FIG. 2 schematically illustrates the operation of the polysiloxane/steam jet. Shown is a steam foil 21 having a discharge slot 22, the width of which is suitably controlled by pneumatic control valves. The slot width "W" of the steam foil can range from about 0.05 to about 0.5 inch depending on the pressure and add-on rate desired. Steam is provided via inlet tube 23, which can be a 2 inch diameter steam hose. The steam is preferably superheated steam having a pressure of about 15 psi or less and a temperature of from about 230° F. to about 240° F. Superheated steam is preferred for its drying capacity to avoid wetting the sheet and adversely affecting the sheet properties. Polysiloxanes or other materials are supplied from a pressurized container 24 which is pressurized with air via conduit 26. A dip tube 27 extends below the liquid level of the polysiloxane or other material and feeds the material under pressure, suitably from about 20 to about 50 psi, to an atomizing nozzle 28. The atomizing nozzle injects the polysiloxane or other material into the steam inlet tube, preferably in the form of a fan spray to optimize the uniform distribution of the polysiloxane or other material within the steam. The velocity of the atomized polysiloxane or other material should be less than the velocity of the steam at that point so that the steam carries the atomized polysiloxane or other material. The steam foil is provided with drain valves 29 to remove condensate from the steam foil.

In operation, the steam foil sprays the steam/polysiloxane mixture onto the surface of the tissue web 30 travelling immediately above or below the surface of the foil.

EXAMPLES

Example 1

A 5 weight percent aqueous polysiloxane solution (Dow Corning 108 Emulsion) contained in a plastic vessel was fed to an atomizing spray nozzle of a pressurized spray device (Crown Spray-Tool Model No. 8011) activated by a can of volatile propellant pressurized to 62 pounds per square inch. When released, the pressurized propellant passed through the atomizing spray nozzle and drew the polysiloxane solution into the nozzle by aspiration, thereby producing an atomized polysiloxane spray. At the same time, a flow of saturated steam was produced by a Norelco hand-held steamer (Model No. TS-60). The atomized polysiloxane spray was directed into the steam flow to produce a polysiloxane/steam mixture. The mixture was directed at the surface of a two-ply tissue having a basis weight of 18 pounds per 2880 square feet. The tissue was suspended from a crossbar by taping the top portion of the tissue to the bar and held under constant stress by taping the bottom portion of the tissue to a weighted rod. The tissue was contacted with the polysiloxane/steam mixture for about 1 or 2 seconds. The resulting tissue was noticeably bulkier and had a slicker feel than the untreated tissue. The resulting tissue was also noticeably bulkier than a silicone-treated tissue without steam and slicker-feeling than a steam-treated tissue without silicone.

Example 2

A two-ply tissue having a basis weight of 18 pounds per 2880 square feet was treated as in Example 1, except a 5 weight percent solution of dialkyldimethyl ammonium chloride (debonder) was substituted for the polysiloxane solution. As with the tissue of Example 1, the resulting tissue was also bulkier and felt more slick than the untreated tissue.

It will be appreciated that the foregoing description and examples, given for purposes of illustration, are not to be construed as limiting the scope of the claims set forth below and all equivalents thereto.

What is claimed is:

1. A method of applying a debonder to a tissue web comprising atomizing an aqueous solution of the debonder, dispersing the atomized debonder solution with steam to form a debonder/steam mixture, and spraying the atomized debonder/steam mixture onto a surface of the tissue web.

2. The method of claim 1 wherein the debonder is polysiloxane.

3. The method of claim 1 wherein the debonder is a quaternary ammonium compound.

4. The method of claim 3 wherein the quaternary ammonium compound is dialkyldimethyl ammonium chloride.

5. The method of claim 3 wherein the quaternary ammonium compound is dihydrogenated-tallow dimethylammonium chloride.

6. The method of claim 3 wherein the quaternary ammonium compound is cetra ammonium chloride.

7. The method of claim 1 wherein the steam is superheated.

8. The method of claim 1 wherein the amount of steam in the debonder/steam mixture is from about 0.1 to about 1 weight percent, based on the weight of the debonder.

9. The method of claim 1 wherein the amount of debonder added to the surface of the tissue is from about 0.1 to about 5 weight percent.

10. A method of applying polysiloxane to a tissue web comprising atomizing an aqueous solution of the polysiloxane, dispersing the atomized polysiloxane with steam to form a polysiloxane/steam mixture having from about 0.1 to about 1 weight percent steam based on the weight of the polysiloxane, and spraying the atomized polysiloxane/steam mixture onto the surface of the tissue web.

* * * * *